US006817922B1

(12) United States Patent
Davies

(10) Patent No.: US 6,817,922 B1
(45) Date of Patent: Nov. 16, 2004

(54) NOISE MAKER CONFIGURED AS A SPORTS ARTICLE

(76) Inventor: Holly P. Davies, 12424 S. 38th Pl., Phoenix, AZ (US) 35044

( * ) Notice: Subject to any disclaimer, the term of this patent is extended or adjusted under 35 U.S.C. 154(b) by 0 days.

(21) Appl. No.: 10/461,189

(22) Filed: Jun. 13, 2003

(51) Int. Cl.[7] ..... A63H 5/00
(52) U.S. Cl. ..... 446/418; 446/81; 446/421
(58) Field of Search ..... 446/418, 419, 446/421, 81, 420, 422

(56) References Cited

U.S. PATENT DOCUMENTS

D151,599 S * 11/1948 Colm
D151,600 S * 11/1948 Colm
2,514,844 A * 7/1950 Cohen
2,559,384 A * 7/1951 Anderson, Jr.
4,454,204 A * 6/1984 Posey ..... 428/542.4
4,463,517 A * 8/1984 Kerr et al. ..... 446/421
4,976,651 A * 12/1990 Frank ..... 446/421
D339,384 S * 9/1993 Seifan ..... D21/64
D403,323 S * 12/1998 Davies ..... D14/187
5,984,761 A * 11/1999 Kalinowski ..... 446/421
2001/0034177 A1 * 10/2001 Hunn ..... 446/73

FOREIGN PATENT DOCUMENTS

JP 10268869 A * 10/1998 ..... G10K/11/08

* cited by examiner

*Primary Examiner*—Derris H. Banks
*Assistant Examiner*—Ali Abdelwahed
(74) *Attorney, Agent, or Firm*—Gregory J. Nelson

(57) ABSTRACT

A noise maker for sports enthusiasts having two identical sections shaped to replicate the appearance of a sports article such as a baseball. The sections each have an inner and outer shell defining sound chambers. The sections are joined at a common grip. When one section is struck on a surface, a loud, sharp noise emanates. Striker projections on the edge of the shells engage when the device is manipulated to further create sounds.

8 Claims, 2 Drawing Sheets

NOISE MAKER CONFIGURED AS A SPORTS ARTICLE

FIELD OF THE INVENTION

The present invention relates to a noise making device and more particularly relates to a percussion or clapper-type noise making device configured in the shape of a sports article for use by sports fans at rallies, games and similar events.

BACKGROUND OF THE INVENTION

Fans of organized team athletic events attend games and sporting events and exhibit support of their favorite teams in various ways. Many fans will carry banners or wear apparel in their chosen team colors with the team logo prominently displayed. Some of the more enthusiastic fans paint their faces and body in team colors. These fans also express themselves vocally during such events by cheering and yelling for their team and often by voicing displeasure directed to the opposing team and sometimes the officials by yelling, booing and jeering.

Many fans wish to express their support of their favorite team and exhibit enthusiasm using noise makers of various types. For example, noise makers may consist of air horns, megaphones, rattles and similar devices which will emit loud sounds. The display of team banners and colors, sometimes accompanied by raucous noise, is considered a part of the normal exuberance of being a sports fan and occurs at most levels of athletic activity, from Little League through high school to collegiate activities and professional athletics.

In view of the foregoing, there exists a need for a percussion-type noise maker which may be provided to sports fans, which noise maker is in the configuration of a sports item for a particular sport such as baseball, soccer ball, football and the like. Further, there exists a need for such noise maker which will accommodate placement of a team logo or team indicia, which device can be manufactured and provided to the sports fan inexpensively and which is suitable for use at sporting events.

BRIEF SUMMARY OF THE INVENTION

Briefly, the present invention provides a percussion-type noise maker that is shaped or configured to replicate an item of sporting equipment such as a ball or other item used in a particular sporting activity. The device consists of a body having two sections each of which are preferably molded of suitable plastic having an outer shell configured in the shape of the sporting article and an inner shell spaced from the outer shell. A sound chamber or percussion chamber is defined between the inner and outer shell of each section. A chamber is also defined between the inner shells of the two sections. A handle portion extends from the body. The two sections are identical and each is in the shape of a completed article such as a sports ball provided with one or more vent holes to allow sound and air to escape. The handle portion of the two sections are inserted into a common outer grip which can be held by the user. When the device is held by the grip and struck against a surface, the two body sections will form 'clappers' which will create a loud noise which noise is amplified by the chambers in the shell sections. The vents allow the sound to escape from between the sections. The resulting sound is a highly audible staccato sound that the user can repeatedly generate as the device is repeatedly struck on a hard surface.

BRIEF DESCRIPTION OF THE DRAWINGS

The above and other objects will be more fully understood from the following, description, claims and drawings in which:

DETAILED DESCRIPTION OF THE DRAWINGS

Figure 2:
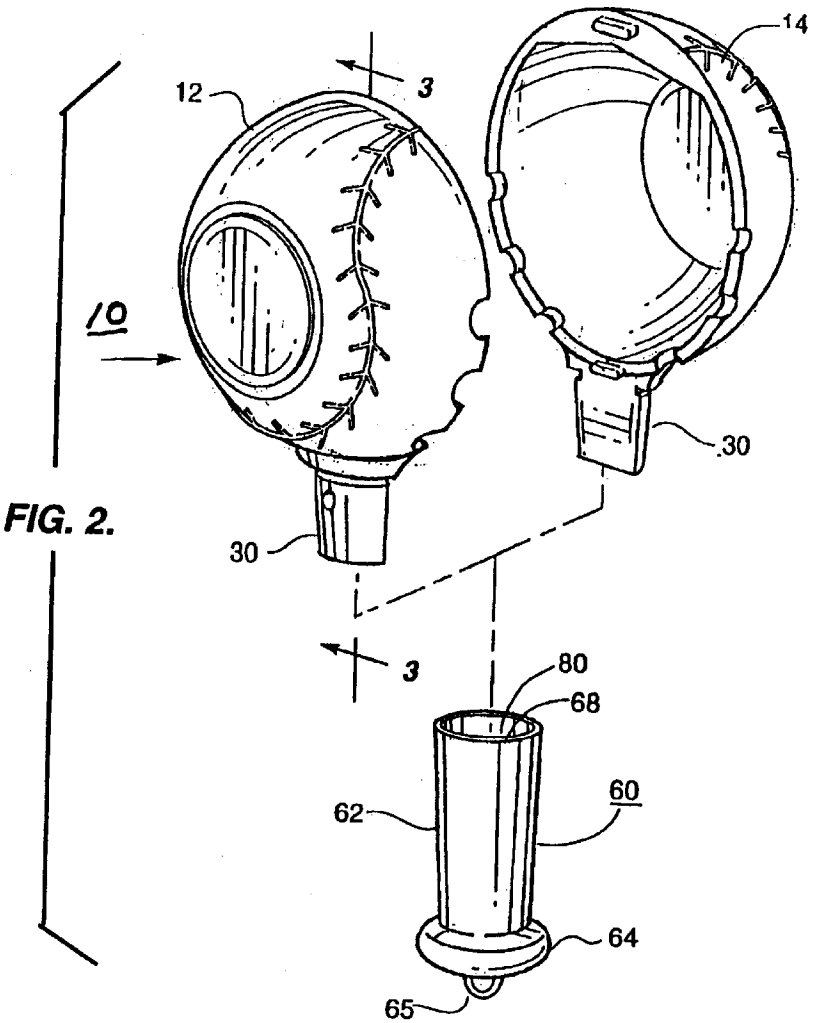
FIG. 2 is an exploded view of the embodiment of the noise maker device shown in FIG. 1.
Figure 1:
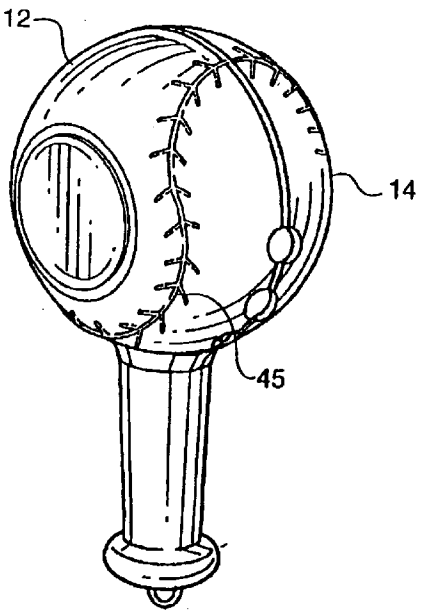
FIG. 1 is a perspective view of an embodiment of the noise maker device of the present invention which is shown having the configuration of a sports article, namely a baseball.
Figure 3:
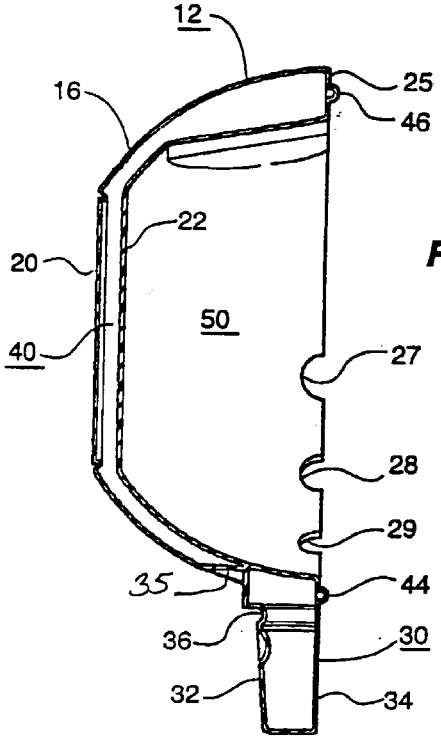
FIG. 3 is a cross-sectional view taken along line 3—3 of FIG. 2 and representative of both body sections of the noise maker device.

Turning now to the drawings, particularly FIGS. 1 to 3, a preferred embodiment of the noise maker of the present invention is shown and is generally designated by the numeral 10. The noise maker is a percussion-type noise maker of the clapper type having two cooperating body sections 12 and 14. Sections 12 and 14 are identical thereby providing common manufacturing efficiency as only a single set of tooling is required to make both body sections. Preferably the body sections are fabricated from a suitable plastic using plastic molding technology such as injection molding or blow molding. Body section 12 consists of an outer shell 16 which is shown as being generally semi-spherical with a planar section 20 which provides a surface to which indicia may be applied such as team emblems or logos. Further, the planar section 20 is provided as a surface which may be struck against a hard surface to generate sound. Spaced from the outer shell is an inner shell 22 which generally conforms in shape to the outer shell defining a chamber 40 therebetween. Another partial chamber 50 is formed by the inner shell 22 which cooperates with the adjacent body section 14 to form a chamber when assembled. An edge 25 extends peripherally between the inner and outer shells. A pair of projections 44 and 46 are provided at opposite locations along the rim or edge 25 of the body sections. A plurality of vents 27, 28 and 29 are shown each being generally semi-circular and provided at spaced locations along the peripheral edge 25. The projections and vents on section 12 align with the projections and vents on section 14.

A handle section 30 is integrally formed with the shells having a generally semi-circular outer surface 32 and a flat inner surface 34 which extends axially. The handle is shown as hollow and a wall 35 separates the handle from the sound chamber 40 defined between the inner and outer shells. A groove 36 extends around the upper end of the handle.

The opposite cooperating body section 14 is constructed in the same manner as the body section 12 described with reference to FIG. 3. As shown in FIG. 2, the two sections when placed in face-to-face engagement form a noise maker with the body formed by the two sections 12 and 14 having a configuration replicating a sports article, in this case a baseball being spherical with the exterior surface having features representing the features of a baseball such as the line of stitching 45.

The noise maker 10 is completed by inserting the cooperating handle sections 30 into an outer grip 60. The outer grip 60 is shown having a generally cylindrical body 62 with a projecting flange 64 at its lower end. A U-shaped loop 65 may be integrally formed in the handle for attachment of a tether or to provide location from which to hang the device when not in use. The handle sections 30 may be frictionally returned in the hollow interior 68 of the grip by engaging annular rib 80 on the interior of the grip with annular groove 36 extending about the two sections 30.

When the device is fully assembled, it appears as shown in FIG. 1. In use, the individual will grasp the grip and then strike one of the flattened surfaces 20 of one of the body sections 12, 14 against a surface. The surface may be a hard surface such as the seat of a bleacher or the device may simply be struck against the extended palm of the user's hand. The rapid and repeated striking of the device against a surface will cause a loud, sharp percussive noise to be generated. Sound generated in the chamber 50 defined by the inner shell is allowed to vent or escape through the vent holes. The chamber 40 in each section enhances the quality of the sound. The striker projections 44, 46 along the edges 25 of the sections will also enhance the sound providing a sharp, loud noise.

Figure 4:
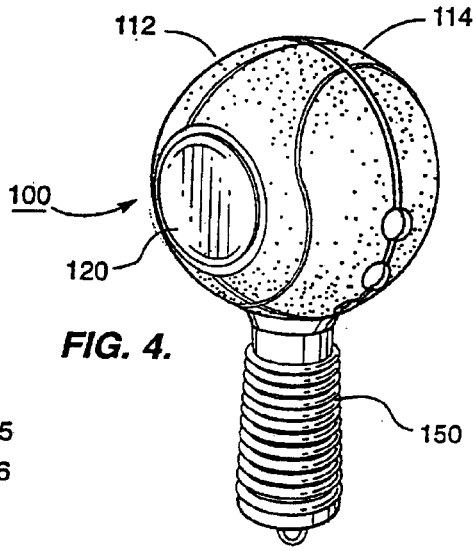
FIG. 4 is a perspective view of an alternate embodiment of the noise maker device having the exterior appearance of a basketball.

FIG. 4 shows an alternate embodiment of the present invention generally designated by the numeral 100, again having two identical sections 112 and 114, each having a projecting handle which is received within a grip 150. The clapper sections 112 and 114 are both generally semi-spherical, each having a flattened portion 120. The generally semi-spherical sections, when assembled, form a sphere, the exterior of which is decorated to have the appearance of a basketball. The body of the device can be colored to further replicate the appearance of a sports article and the flattened areas, which provide a striking surface, may be provided with decorative decals or logos carrying the team name or emblem.

Figure 5:
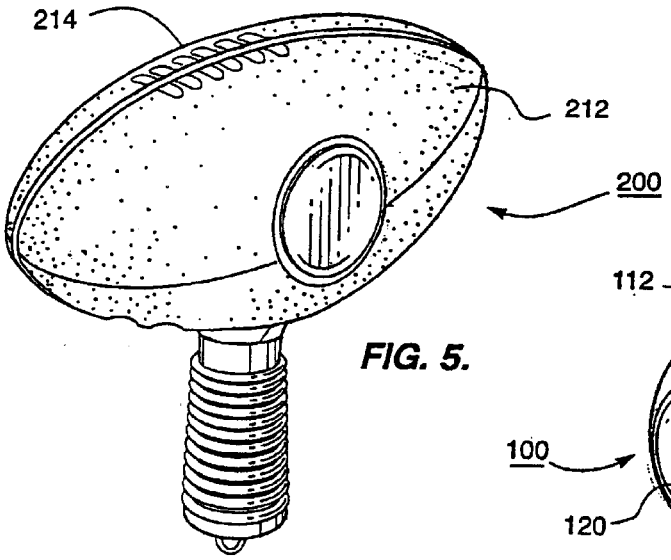
FIG. 5 illustrates yet another embodiment in which the noise maker of the present invention is configured having a shape of sports article, in this case a football.

FIG. 5 shows yet another embodiment of the present invention which is generally designated by the numeral 200. In this embodiment, the noise maker is configured as another sports article, in this case having the general shape of a football. The two sections 212, 214 of the noise maker are each oblate semi-spheroids. Each section carries a handle section which, again, received within a grip which is grasped by the user when the noise maker is used.

While the invention has been specifically described with reference to sport article shapes which are various types of balls, other shapes such as racing cars, bats, golf club heads and other sports articles may be configured to replicate such items.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A manual noisemaker comprising:

(a) a first body section having:

(i) an outer generally curved surface and an inner surface spaced from said outer surface having a shape generally conforming to the shape of the outer surface; and (ii) a peripheral edge connecting said inner and outer surfaces defining a first sound chamber therebetween;

(b) a second body section having:

(i) an outer generally curved surface and an inner surface spaced from said outer surface having a shape generally conforming to the shape of the outer surface; and (ii) a peripheral edge connecting said inner and outer surfaces defining a second sound chamber therebetween;

(c) said first and second body sections being cooperative when placed together to form a third sound chamber between the inner surfaces of said body sections;

(d) vent means in at least one of said body sections extending into said third sound chamber; and (e) grip means attached to said first and second body sections whereby a user may generate a percussive sound by striking one of the body sections against a surface.

2. The manual noise maker of claim 1 wherein said sections define a shape selected from the group consisting of a baseball, football, soccer ball, basketball or tennis ball.

3. The manual noise maker of claim 1 wherein said first and second sections are molded plastic.

4. The manual noise maker of claim 1 wherein said sections have flattened surface portions.

5. The manual noise maker of claim 1 wherein one of said sections carries sports team indicia.

6. The manual noise maker of claim 1 wherein each of said sections has an integral handle which is engaged in a grip.

7. The manual noise maker of claim 1 wherein at least one striker projection is provided on said edge of said sections.

8. The manual noise maker of claim 1 wherein said sections are substantially identical.

* * * * *